United States Patent [19]

Gifford, Jr.

[11] 4,321,800

[45] Mar. 30, 1982

[54] DEHUMIDIFIER STRUCTURE

[75] Inventor: Russell L. Gifford Jr., Galesburg, Ill.

[73] Assignee: Addison Products Company, Addison, Mich.

[21] Appl. No.: 168,136

[22] Filed: Jul. 14, 1980

Related U.S. Application Data

[63] Continuation of Ser. No. 934,367, Aug. 17, 1978, abandoned.

[51] Int. Cl.[3] ..... F25D 21/00; H01H 35/00

[52] U.S. Cl. ..... 62/150; 137/403; 200/61.2; 222/57

[58] Field of Search ..... 62/137, 150, 188; 137/403; 200/61.2, 61.21; 222/57, 64

[56] References Cited

U.S. PATENT DOCUMENTS

| | | | |
|---|---|---|---|
| 2,626,387 | 1/1953 | Berry | 200/61.2 |
| 2,994,204 | 8/1961 | Archer | 62/127 |
| 3,163,019 | 12/1964 | Hall | 62/137 |
| 3,223,284 | 12/1965 | Fann | 222/57 |
| 3,496,731 | 2/1970 | Sholtes | 62/173 |
| 3,500,654 | 3/1970 | Sholtes | 62/150 |
| 3,786,832 | 1/1974 | Marean | 137/403 |

*Primary Examiner*—William E. Wayner
*Attorney, Agent, or Firm*—Beaman & Beaman

[57] ABSTRACT

The invention relates to apparatus for handling atmospheric condensate resulting from the operation of dehumidifier structure wherein the container for the condensate is rocked, as the level of the condensate increases, by a shift in the center of gravity of the container to activate a control and/or signal mechanism.

1 Claim, 3 Drawing Figures

DEHUMIDIFIER STRUCTURE

This is a continuation application of Ser. No. 934,367, filed Aug. 17, 1978, now abandoned.

BACKGROUND OF THE INVENTION

It has been proposed heretofore to employ the weight of the atmospheric condensate provided by dehumidifier structure to activate a control system or signal. Westinghouse Electric Corporation has marketed such a system. See U.S. Pat. Nos. 3,496,731 and 3,500,654.

The condensate containers of prior designs were capable of being either manually removed to be emptied or directly connected to a drain. However, such containers require the use of related expensive control structure as well as separate structures for directing the condensate into the removable container.

SUMMARY OF THE INVENTION

According to the present invention the removable condensate container has as an integral part thereof an elongated collector which is positioned below the cooling coil upon where the atmospheric moisture is condensed.

The container has a bottom structure for supporting the same in predetermined relationship to the dehumidifier structure with one edge of the bottom constituting a fulcrum about which the container rocks under predetermined conditions. To effect the rocking action of the container upon the level of the condensate reaching a predetermined level, the container is so shaped as to shift the center of gravity of the container to the unstable side of the fulcrum.

Upon rocking of the condensate container about the fulcrum portion of the bottom, relative movement between the container and control and/or signal means of suitable design is utilized to actuate the same. By designing the container to move through a substantial arc before being arrested by the associated dehumidifier structure, relatively inexpensive controls may be employed for controlling the operation of the compressor.

DESCRIPTION OF THE PREFERRED EMBODIMENT

Figure 3:
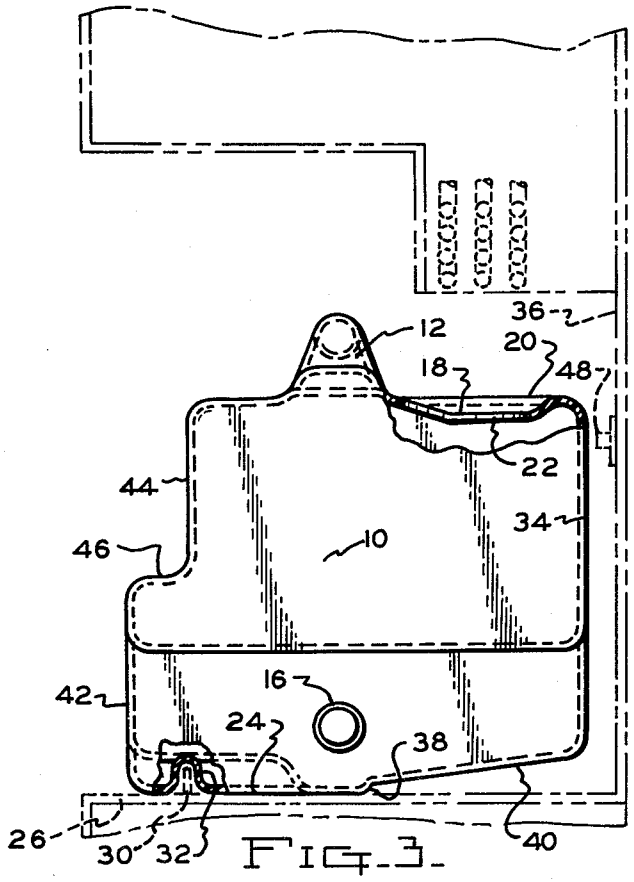
FIG. 3 is an end view of FIG. 1 with the associated dehumidifier structure being shown in dotted outline.
Figure 2:
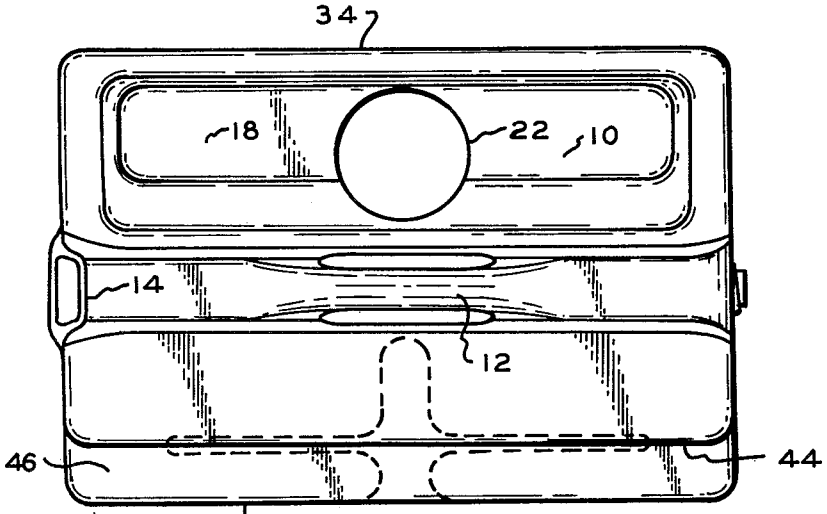
FIG. 2 is a top view of FIG. 1.
Figure 1:
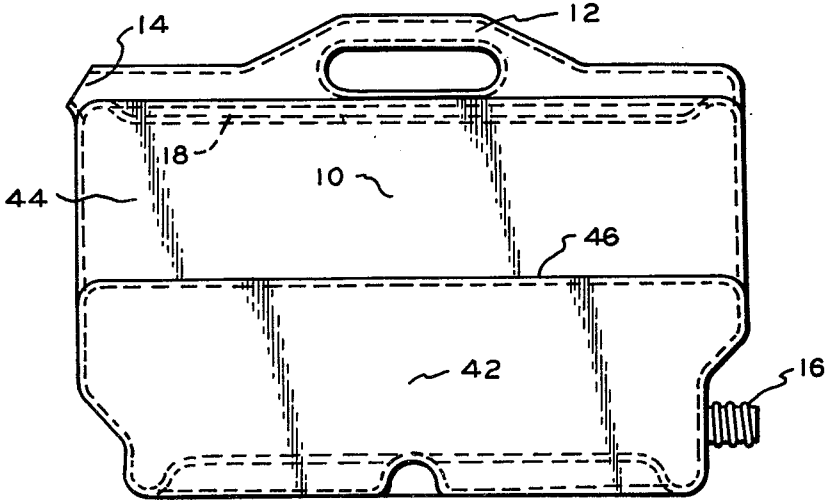
FIG. 1 is a side elevational view of the improved container.

The dehumidifier condensate container 10 may be blow molded polyethylene having a handle 12, a pour spout 14 and a threaded drain connection 16.

An elongated collector 18 is defined in the upper wall 20 as a depression having a central opening 22. In practice the container 10 will be disposed below and vertically spaced from the cooling coil upon which the atmospheric moisture is condensed and drips into the collector 18 and then into the container through the opening 22.

When it is not convenient to discharge the condensate through the drain connection 16, the connection 16 is capped and the container 10 is manually removed from the associated dehumidifier structure, which has a configuration to readily permit removal and installation of the container by vertical movement of the container relative to the dehumidifier structure, and the condensate discharged through the spout 14.

In practice the container 10 has a horizontal bottom wall 24 supported on a suitable horizontal surface 26 of the associated dehumidifier shown in dotted outline. A locating rib 30 is formed in the surface 26 to mate with a cavity 32 in the bottom wall 24 with an interference fit to locate container 10 upon surface 26. With the rib 30 disposed in the cavity 32, the vertical wall 34 of the container 10 will be in spaced relation to vertical surface 36 of the dehumidifier.

As shown in FIG. 3, the horizontal bottom wall 24 terminates in an elongated fulcrum edge 38 which is intersected by the upwardly sloping wall 40 of the container. Opposite the vertical wall 34 are stepped vertical wall portions 42 and 44 connected by the portion 46. When the condensate level in the container 10 is below the wall portion 44, the center of gravity of the container 10 is to the left of the edge 38 as viewed in FIG. 3. However, when the level increases to engage the wall portion 44, the addition of condensate will shift the center of gravity to the right of the edge 38 causing the container 10 to rock clockwise toward the surface 36 of the dehumidifier.

A suitable switch control 48 supported in the dehumidifier structure may be so located as to be engaged and actuated by the wall 34 or 40 before the rocking movement of the container 10 is otherwise arrested. The switch control 48 may be of a plunger type, rocker type or any other suitable form to stop the operation of the compressor and/or signal that the container 10 is in need of being emptied.

Should the drain connection 16 be in service and become clogged, the automatic actuation of the switch control 48 by the container 10 is provided as a safety measure.

It will be readily appreciated that relative movement between any wall portion of the container 10 and the switch control mechanism may be used to activate a control and/or signal. Thus, in lieu of the movement of the walls 34 and 40 toward the dehumidifier structure, movement of the wall 44, for example, away from a control may be used to activate the latter.

I claim:

1. In combination with a dehumidifier structure having a condensate container support surface and a surface supporting a switch control, a portable and bodily removable from said support surface condensate container having a bottom resting on said support surface and having an interference fit therewith to locate said container with respect to said switch control, one edge of said bottom acting as a fulcrum about which said container may rock on said support surface, said container being shaped to locate the center of gravity of the container when empty to the stable side of said fulcrum with the condensate level in one range and to shift the center of gravity to the unstable side of said fulcrum with the level above said range whereby said container is rocked about said fulcrum relative to said switch control to activate the same, said dehumidifier structure and said container being of a configuration providing clearance for the bodily vertical movement of said container for engaging and disengaging said interference fit for the manual removal and installation of said container relative to said support surface.

* * * * *